United States Patent [19]

Shinno et al.

[11] Patent Number: 4,964,383

[45] Date of Patent: Oct. 23, 1990

[54] WATER-COOLED TYPE INTERNAL COMBUSTION ENGINE FOR FARMING MOTOR VEHICLE

[75] Inventors: Yoshio Shinno; Yasuhiko Nakade, both of Sakaishi, Japan

[73] Assignee: Kubota Ltd., Osaka, Japan

[21] Appl. No.: 461,144

[22] Filed: Jan. 4, 1990

[30] Foreign Application Priority Data

Jan. 11, 1989 [JP] Japan ..... 1-2264[U]

[51] Int. Cl.[5] ..... F02F 7/00

[52] U.S. Cl. ..... 123/195 C; 123/41.49; 60/320; 180/309; 181/262

[58] Field of Search ..... 123/41.31, 41.47, 41.48, 123/41.49, 41.64, 192 R, 195 C, 198 E; 165/135; 60/317, 320, 321; 180/68.4, 89.2, 309; 181/225, 227, 228, 259, 262

[56] References Cited

U.S. PATENT DOCUMENTS 4,011,849 3/1977 Latham ..... 123/41.64

4,917,201 4/1990 Fujikawa et al. ..... 180/68.4

FOREIGN PATENT DOCUMENTS 61-32510 2/1986 Japan .

*Primary Examiner*—Noah P. Kamen

*Attorney, Agent, or Firm*—Lowe, Price, Leblanc, Becker & Shur

[57] ABSTRACT

A water-cooled type internal combustion engine for a farming motor vehicle has a muffler arranged within the space on the lateral side of an engine body disposed in the fore and rear direction of the farming motor vehicle. An exhaust gas dilution pipe is externally fitted at its upper end portion to an outlet pipe of the muffler so as to provide a cooling air passage gap therebetween. The lower end portion of the dilution pipe is extended below the projected end portion of the outlet pipe. A portion of the cooling air delivered by the operation of a radiator fan so as to pass through a radiator is guided by means of a muffler cover so as to be forcedly fed into the dilution pipe through the cooling air passage gap in order to facilitate the dilution of the exhaust gas.

6 Claims, 3 Drawing Sheets

WATER-COOLED TYPE INTERNAL COMBUSTION ENGINE FOR FARMING MOTOR VEHICLE

BACKGROUND OF THE INVENTION

1. Field of the Invention

The present invention relates to a water-cooled type internal combustion engine mounted to a farming motor vehicle such as a tractor and a combine harvester and more particularly to a device adapted to cool a muffler of such an engine by means of a radiator fan.

2. Description of the Prior Art

Conventionally an engine for a farming motor vehicle is provided with a muffler which is projected upward largely from an engine room of the motor vehicle. In recent years in an attempt to improve an external appearance of the motor vehicle, the muffler is mounted within the engine room.

As such a muffler of the type mounted within the engine room has been known the one disclosed in Japanese Provisional Utility Model Publication No. 1986-32510.

Here, in the engine room extending in the fore and rear direction of the motor vehicle there are arranged a radiator, a radiator fan and an engine body in order from foreside while a muffler body is arranged in a space on the lateral side of the engine body so as to extend in the fore and rear direction. An exhaust outlet pipe is projected downward from the upwind side end portion of the muffler body, and a muffler cover is mounted to the muffler body with a cooling air passage provided therebetween for cooling the muffler. A portion of cooling air flow delivered by means of the radiator fan is introduced into the muffler cooling air passage so as to pass therethrough.

In the aforementioned conventional embodiment there is the advantage in that the muffler body is adapted to be cooled by means of the cooling air flow delivered from the radiator fan so as to prevent the temperature within the engine room from being raised by a heat of the muffler body and to cool down the temperature of an exhaust gas discharged from the outlet pipe.

There is, however, a following disadvantage associated with the conventional embodiment. That is, since it is required to increase a quantity of the cooling air flow delivered by means of the radiator fan when the temperature of the exhaust gas from the outlet pipe is intended to be further cooled down, the radiator fan becomes large in size and resultantly the engine itself becomes large in overall size.

SUMMARY OF THE INVENTION

It is an object of the present invention to provide a water-cooled type internal combustion engine for a farming motor vehicle wherein the engine can be manufactured compact in overall size while the temperature of the exhaust gas discharged from the engine is lowered.

For accomplishing the above-mentioned object, the present invention is constructed as follows.

An engine room of a farming motor vehicle has a first space and a second space arranged side by side in the fore and rear direction thereof. The first space accommodates an engine body disposed along the fore and back direction, and the second space accommodates a radiator and a radiator fan disposed side by side in the fore and rear direction. The radiator fan is arranged so that the cooling air can be delivered therefrom to the first space after passing through the radiator in the fore and rear direction. The space on the lateral side of the engine body accommodates a muffler body of a muffler disposed in the fore and rear direction, and an exhaust gas outlet pipe is projected from the downwind side portion of the muffler body. A pipe for diluting the exhaust gas is fitted externally at its first end portion to the outlet pipe so as to provide an cooling air passage gap therebetween. The second end portion of the dilution pipe is extended below the projected end portion of the outlet pipe. The muffler body is covered by a muffler cover so as to provide an air passage for cooling the muffler therebetween. The muffler cooling air passage comprises an air passage inlet facing the second space, an air passage portion and an air passage outlet facing the cooling air passage gap kept in communication to each other in order.

According to the above-mentioned construction, the cooling air flow is delivered by the operation of the radiator fan so as to pass through the radiator and then a portion thereof is guided by means of the muffler cover so as to be introduced into the muffler cooling air passage, to cool the muffler body during passing through the passage and then to be forced into the dilution pipe from the air pressure outlet via the cooling air passage gap. The high temperature exhaust gas discharged from the outlet pipe of the muffler is mixed sufficiently with a cooling air and diluted thereby within the dilution pipe so as to be discharged from the second end portion of the dilution pipe with its temperature lowered sufficiently.

Accordingly, since it is not necessary to enlarge the capacity of the radiator fan for lowering the exhaust gas temperature, the engine can be manufactured compact in overall size while being capable of lowering the exhaust gas temperature.

Further, according to the present invention, since the muffler cover is used also as an air guide cover for the exhaust gas dilution pipe, it is not necessary to provide another air guide cover separately. Therefore, it becomes possible to simplify the construction of the muffler device and manufacture it at a low cost.

The above and other objects and advantages of the present invention will be become more apparent from the following description of the invention with reference to the attached drawings.

BRIEF DESCRIPTION OF THE DRAWINGS

FIG. 1 is a side view of a lawn mower tractor;

FIG. 2 is a plan view of an engine mounted to the tractor;

FIG. 3 is a view taken along III—III directed line in FIG. 2;

FIG. 4 is a view taken along IV—IV directed line in FIG. 2;

FIG. 5 is a view corresponding to FIG. 3; and

FIG. 6 is a partial view corresponding to FIG. 4.

DESCRIPTION OF THE PREFERRED EMBODIMENTS

First Embodiment

FIGS. 1 through 4 show a first embodiment.

Figure 2:
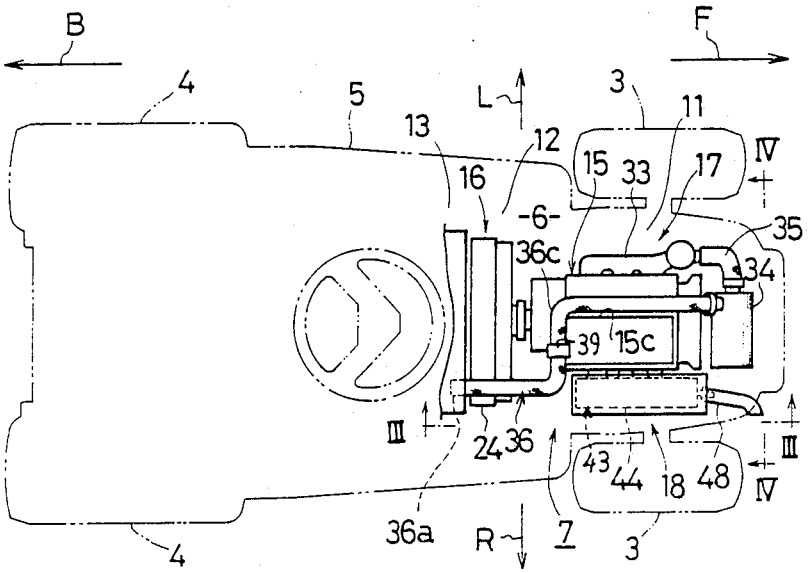
FIGS. 1 through 4 show a first embodiment of the present invention.
Figure 1:
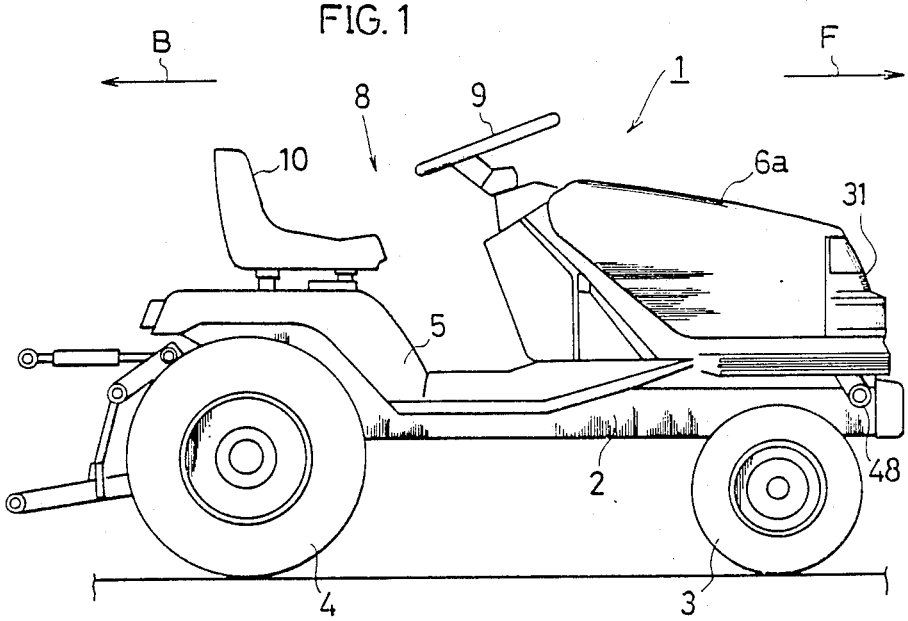

FIGS. 1 and 2, a lawn mower tractor 1 as a farming motor vehicle has a frame 2 elongated in the fore and rear direction and supported by means of front wheels 3, 3 and rear wheels 4, 4 and a body 5 fixedly secured onto the frame 2. An engine room 6 is formed in the foreside portion of the body 5, and a water-cooled type gasoline engine 7 is mounted within the engine room 6. In the rear side portion of the body 5 there is provided a driver's cab 8 including a steering wheel 9, a seat 10 and the like. Incidentally, the symbol R and the symbol L in FIG. 2 designate the right side and the left side with respect to the advancing direction of the tractor 1 respectively.

Figure 4:
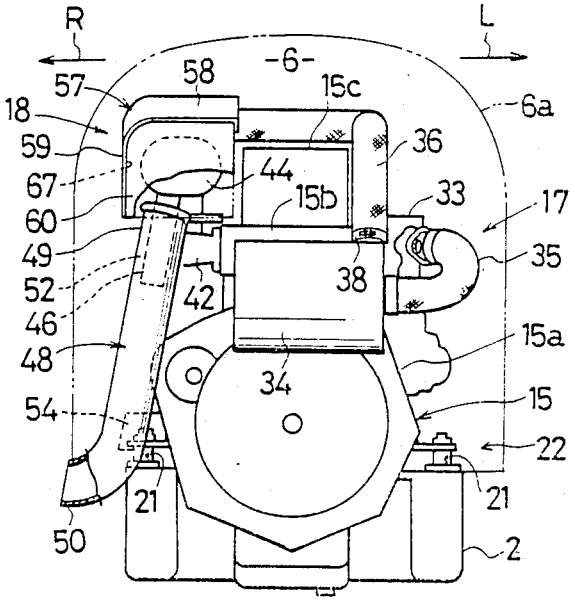

Then the engine room 6 and the engine 7 will be explained with reference to FIGS. 2 through 4.

The engine room 6 comprises a first space 11, a second space 12 and a third space 13 arranged in order from the foreside F to the rear side B. The engine 7 comprises a vertical three-cylinder type engine body 15 and attached apparatuses such as a cooling apparatus 16, an intake apparatus 17, an exhaust apparatus 18 and the like.

The engine body 15 comprises a cylinder block **15*a*, a cylinder head 15*b* and a head cover 15*c* both of which are fixedly secured to the upper side of the cylinder block 15*a* in order upward and has an output shaft 20 disposed in the first space 11 of the engine room 6 so as to face the rear side B. The cylinder block 15*a* is supported by the frame 2 through a vibration isolating support means 22 provided with four vibration isolating rubbers 21**.

The cooling apparatus 16 has a radiator 24 and a radiator fan 25 arranged within the second space 12 in order from the rear side B. The radiator 24 is supported by the frame 2 through a plurality of vibration isolating rubbers 26. A input shaft 27 of the radiator fan 25 is connected interlockingly to the output shaft 20 of the engine body 15 through a transmission belt 28. When the radiator fan 25 is operated, the cooling air is sucked into the third space 13 through an open air intake opening 30 which is provided on the rear side B of the engine room 6 and then flows forward within the first space 11 after passing forward through the radiator 24 within the second space 12. Subsequently, the cooling air is discharged through foreside discharge openings 31 provided on the foreside F of a cover member **6*a* for an engine room 6 and lower side discharge openings 32 provided on the lower side of the engine room 6**.

The intake apparatus 17 has an intake manifold 33 fixedly secured onto the left side surface of the engine body 15 and an air cleaner 34 disposed within the space of the foreside F of the engine body 15. The intake manifold 33 and the air cleaner 34 are connected in communication to each other through a first rubber intake pipe 35. The open air is adapted to be introduced into the air cleaner 34 through a second rubber intake pipe 36.

Figure 3:
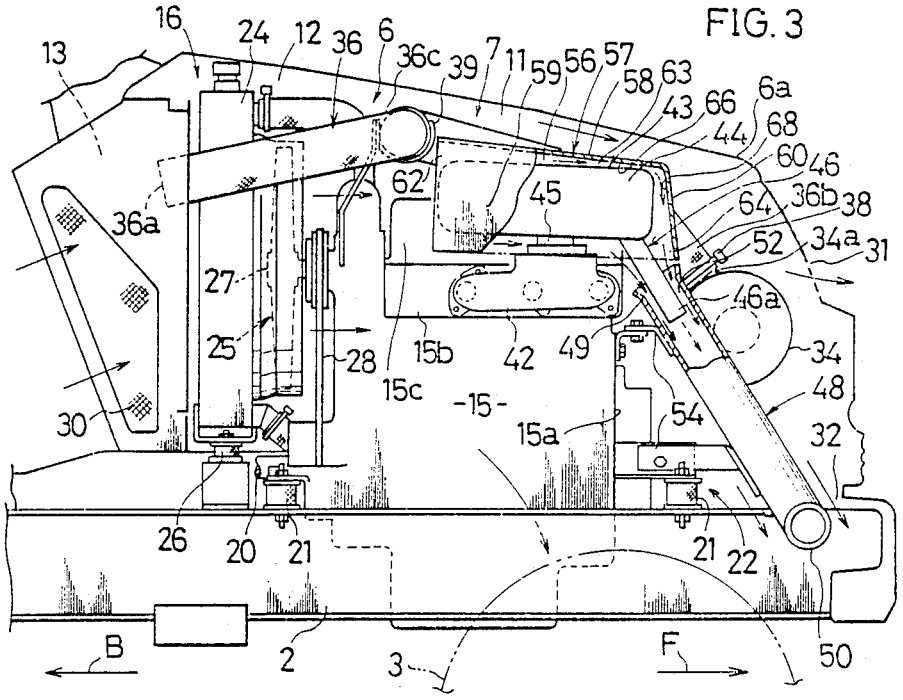

As shown mainly in FIG. 3, the second intake pipe 36 is arranged so that its rear side intake end portion **36*a* is located within the right side portion of the third space 13 and its foreside end portion 36*b* is connected to the intake nozzle 34*a* of the air cleaner 34 by means of a tightening band 38. The intermediate portion 36*c* of the second intake pipe 36 is bent so as to run along the rear side as well as the left side of the head cover 15*c* of the engine body 15 with being spaced apart upward therefrom, and is supported at its middle position by the engine body 15 through a pipe stay 39**.

The exhaust apparatus 18 has an exhaust manifold 42 and a muffler 43 disposed within the space on the right side R of the engine body 15. The muffler 43 has a muffler body 44, an exhaust gas inlet pipe 45 and an exhaust gas outlet pipe 46. The muffler body 44 is arranged above the exhaust manifold 42 along the fore and rear direction. These muffler body 44 and exhaust manifold 42 are connected to each other through the inlet pipe 45. The outlet pipe 46 is projected from the foreside lower end portion of the muffler body 44 so as to face downward, but slantly to the downward side with respect to the cooling air flow, and the exhaust gas is adapted to be discharged from its projected end portion **46*a***.

The exhaust apparatus 18 has a dilution pipe 48 for diluting the exhaust gas. The exhaust gas dilution pipe 48 has an upper end portion 49 as its first end portion and a lower end portion 50 as its second end portion. The upper end portion 49 of the dilution pipe 48 is externally fitted to the outlet pipe 46 so as to provide an air flow passage gap 52 therebetween. The lower end portion 50 of the dilution pipe 48 is extended below the projected end portion **46*a* of the outlet pipe 46 so as to be projected outside the cover member 6*a* for the engine room 6. The dilution pipe 48 is fixedly secured to the cylinder block 15*a* through a fixing means 54 provided with an upper bracket and a lower bracket. Therefore, since the dilution pipe 48 is adapted to be vibrated together with the engine body 15 supported by the vibration isolating support means 22**, its breakage due to engine vibrations can be prevented.

The muffler body 44 is covered by a muffler cover 57 so as to provide a muffler cooling air flow passage 56 therebetween. The muffler cover 57 has an upside plate 58, an outer lateral side plate 59 and a foreside plate 60. The muffler cooling air flow passage 56 comprises a passage inlet 62 facing the second space 12 of the engine room 6, a passage portion 63 and a passage outlet 64 facing the aforementioned passage gap 52 connected in communication to each other in order. A ceiling surface 66 of the passage portion 63 is defined by the lower surface of an upside plate 58 of the muffler cover 57, an outer lateral side surface 67 thereof 63 is defined by the inner surface of the outer lateral side plate 59, and a downwind side surface 68 thereof 63 is defined by the foreside plate 60 respectively.

Thereupon, a portion of the cooling air delivered to the foreside F within the first space 11 by the operation of the radiator fan 25 is adapted to pass through the muffler cooling air flow passage 56 while passing through the gap between the cover member **6*a* for the engine room 6 and the muffler cover 57. The cooling air flow passing through the muffler cooling air flow passage 56 is forcedly fed into the dilution pipe 48 through the passage gap 52 so as to dilute the high temperature exhaust gas discharged from the outlet pipe 46 and lower the exhaust gas temperature sufficiently. Subsequently, it is discharged laterally together with the exhaust gas from the lower end portion 50 of the dilution pipe 48**.

Further, since the upside plate 58 of the muffler cover 57 is inclined forward downward, the ceiling surface 66 of the passage portion 63 reduces its height dimension gradually as it extends from its upwind portion on the rear side B to its downwind portion on the foreside F. Accordingly, the cooling air flow is smoothly guided into the passage gap 52 so as to facilitate the dilution of the exhaust gas discharged from the outlet pipe 46.

According to this embodiment, the following advantages are provided.

Since the engine body 15 being lower in height dimension than the radiator 24 is arranged within the foreside space of the engine room 6, the cover member 6a for the engine room 6 can be formed in a forward downward inclined configuration so that the forward sight from the driver's cab 8 can be improved and the external appearance of the tractor 1 can be improved.

Further, since the radiator fan 25 is adapted to be driven by the output shaft 20 of the engine body 15, the construction of such a driving system can be simplified.

Since the second intake pipe 36 is formed of a rubber pipe, the piping work can be carried out readily. Since the pipe 36 is arranged on the side opposed to the muffler 43 with respect to the engine body 15, its burning damage due to the heat radiated from the muffler 43 can be prevented.

Second Embodiment

Figure 6:
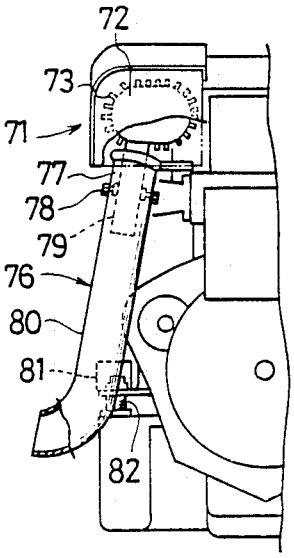
FIGS. 5 and 6 show a second embodiment of the present invention.
Figure 5:
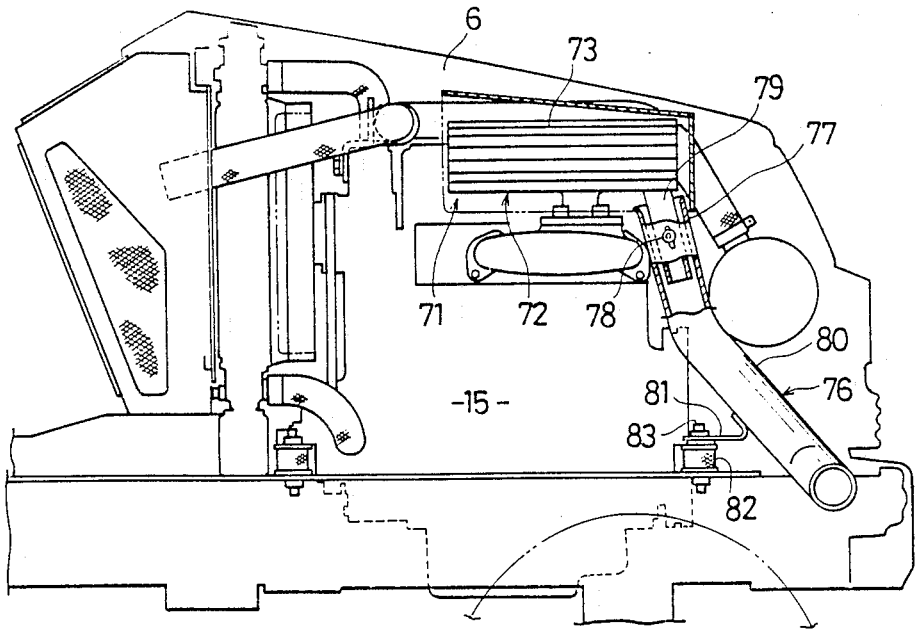

FIGS. 5 and 6 show the second embodiment. FIG. 5 is a view corresponding to FIG. 3, and FIG. 6 is a view corresponding to FIG. 4.

A muffler body 72 of a muffler 71 has a large number of cooling fins 73 provided at its surrounding surface so as to extend in the fore and rear direction. Therefore, the muffler body 72 can be cooled sufficiently by means of a cooling air flow so as to restrain the engine room 6 from being heated by the heat radiated from the muffler body 72.

The exhaust gas dilution pipe 76 is fixedly secured at its upper end portion 77 to the exhaust outlet pipe 79 by means of a plurality of fixing members 78 as well as attached at its midway portion 80 to the engine body 15 through both a bracket 81 and a vibration isolating rubber 82 tightened to each other by a nut 83.

The respective embodiments may be modified as described in the following items (a) through (c).

(a) The exhaust outlet pipe of the muffler may be projected forward substantially straight from the fore end surface of the muffler body as the downwind side end surface thereof instead of being projected forward downward slantly from the lower portion of the muffler body.

(b) The radiator fan may be arranged within the space on the rear side B of the radiator so as to operate as a forced draft fan instead of being arranged within the space on the foreside F of the radiator.

(c) The first space, the second space and the third space of the engine room may be arranged in order from the rear side B to the foreside F instead of being arranged in order from the foreside F to the rear side B. Accordingly, the engine body may be arranged within the rear side portion of the engine room.

By the way, the frame and the body of the farming motor vehicle may be manufactured integratedly by means of a sheet metal processing instead of being manufactured separately as illustrated.

Though the engine mounted to the lawn mower tractor was explained in the above-mentioned respective embodiments, the engine according to the present invention may be applied to other kinds of farming motor vehicles such as an ordinary tractor, a combine harvester and the like.

What is claimed is:

1. A water-cooled type internal combustion engine for a farming motor vehicle having an engine room including a first space and a second space arranged side by side in the fore and rear direction of the farming motor vehicle, which internal combustion engine comprising:

an engine body disposed in the fore and rear direction within the first space of the engine room;

a radiator and a radiator fan arranged side by side in the fore and rear direction within the second space, said radiator fan being disposed so that a cooling air can be delivered to the first space after passing through the radiator in the fore and rear directions;

a muffler having a muffler body and an exhaust gas outlet pipe, said muffler body being disposed in the fore and rear direction within the space on a lateral side of the engine body, said outlet pipe being projected from a downwind side portion of the muffler body and having a projected end portion;

an exhaust gas dilution pipe having a first end portion and a second end portion and being externally fitted at its first end portion to the outlet pipe so as to provide a cooling air passage gap therebetween, said second end portion being extended below the projected end portion of the outlet pipe;

a muffler cover covering the muffler body so as to provide a muffler cooling air passage therebetween; and said muffler cooling air passage comprising an air passage inlet facing said second space, an air passage portion and an air passage outlet facing the cooling air passage gap kept in communication to each other in order.

2. A water-cooled type internal combustion engine for a farming motor vehicle as defined in claim 1, wherein and first space is arranged at the fore side portion of the engine room, and said second space is arranged at the rear side portion of the engine room.

3. A water-cooled type internal combustion engine for a farming motor vehicle as defined in claim 2, wherein said engine body has an output shaft arranged on the rear side thereof, said radiator and said radiator fan are arranged within the second space in order from the rear side, and said radiator fan has an input shaft which is connected interlockingly to the output shaft of the engine body.

4. A water-cooled type internal combustion engine for a farming motor vehicle as defined in claim 1, wherein said exhaust gas outlet pipe is projected downward slantly to the downwind side with respect to the cooling air flow, and said air passage portion of the muffler cooling air passage has a ceiling surface comprising an upwind side portion and a downwind side portion, an outer lateral side surface projected downward from the outer lateral side portion of the ceiling surface and a downwind side surface projected downward from the downwind side portion of the ceiling surface.

5. A water-cooled type internal combustion engine for a farming motor vehicle as defined in claim 4, wherein said ceiling surface reduces its height dimension gradually as it extends from the upwind side portion to the downwind side portion.

6. A water-cooled type internal combustion engine for a farming motor vehicle as defined in claim 1, wherein said engine body is supported by a frame of the motor vehicle through a vibration isolating support means, and said exhaust gas dilution pipe is fixedly secured to the engine body by means of a fixing means.

* * * * *